US007360517B2

(12) United States Patent
Hammer et al.

(10) Patent No.: US 7,360,517 B2
(45) **Date of Patent: *Apr. 22, 2008**

(54) VALVE ACTUATOR FOR ACTUATING A GAS EXCHANGE VALVE OF AN INTERNAL COMBUSTION ENGINE

(75) Inventors: Uwe Hammer, Hausham (DE); Peter Lang, Weissach (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/535,132

(22) PCT Filed: Jun. 4, 2003

(86) PCT No.: PCT/DE03/01853

§ 371 (c)(1),
(2), (4) Date: Dec. 13, 2005

(87) PCT Pub. No.: WO2004/051058

PCT Pub. Date: Jun. 17, 2004

(65) Prior Publication Data

US 2006/0137639 A1 Jun. 29, 2006

(30) Foreign Application Priority Data

Dec. 2, 2002 (DE) ..... 102 56 242

(51) Int. Cl.
*F01L 1/14* (2006.01)

(52) U.S. Cl. ..... 123/90.48; 123/90.52; 123/90.24; 123/90.12; 123/188.3; 74/579 R

(58) Field of Classification Search ..... 123/90.48, 123/90.11
See application file for complete search history.

(56) References Cited

U.S. PATENT DOCUMENTS

| | | | | |
|---|---|---|---|---|
| 5,213,072 | A * | 5/1993 | Dohring | 123/90.48 |
| 5,485,815 | A * | 1/1996 | Shida | 123/188.3 |
| 6,729,287 | B2 * | 5/2004 | Hammer et al. | 123/90.48 |
| 6,871,619 | B2 * | 3/2005 | Hammer et al. | 123/90.12 |

FOREIGN PATENT DOCUMENTS

| | | |
|---|---|---|
| DE | 101 16 218 | 10/2002 |
| DE | 102 28 702 | 4/2003 |
| EP | 0 391 507 | 10/1990 |
| EP | 0 949 030 | 10/1999 |
| FR | 1 489 160 | 7/1967 |

* cited by examiner

*Primary Examiner*—Thomas Denion
*Assistant Examiner*—Kyle M. Riddle
(74) *Attorney, Agent, or Firm*—Kenyon & Kenyon LLP

(57) ABSTRACT

A valve actuator for operating a gas exchange valve of an internal combustion engine has a sleeve-shaped positioning piston which is connected to a valve stem, has at least two shell-shaped wedge pieces enclosing a stem end of the valve stem, whose radially outer peripheral surfaces have a conical segment which tapers off with increasing distance from the gas exchange valve and which is at least partially surrounded by a conical clamping sleeve having a mating conical inner surface and is connected to the positioning piston. The wedge pieces are axially form-fittingly and rotatably connected to a threaded bolt. A threaded segment is provided on the threaded bolt via which the wedge pieces and the conical clamping sleeve are axially attachable to one another.

8 Claims, 2 Drawing Sheets

VALVE ACTUATOR FOR ACTUATING A GAS EXCHANGE VALVE OF AN INTERNAL COMBUSTION ENGINE

BACKGROUND INFORMATION

German Patent Application No. DE 10 116 218 describes a valve actuator, in which one stem end of the gas exchange valve is connected to a positioning piston of the valve actuator via at least two shell-shaped wedge pieces which enclose the stem end and are axially supported by the positioning piston, the radially outer peripheral surface of the wedge pieces having a conical shape and being enclosed by a conical clamping sleeve. The conical clamping sleeve has a radially inner peripheral surface, whose shape is complementary to the conical angle of the wedge pieces and which is axially clamped against the wedge pieces by a threaded connection formed on the wedge pieces. Due to the conical angle and thread on the wedge pieces, these are relatively complex components, which are very costly to manufacture.

SUMMARY OF THE INVENTION

According to the present invention, a threaded bolt, axially form-fittingly and rotatably connected to the wedge pieces, is provided for connecting the gas exchange valve to the valve actuator. The manufacturing complexity is considerably reduced due to the provision of the conical angle and threaded connection functions on separate components.

According to a preferred embodiment, the wedge pieces may extend beyond the stem end as an axial extension of the valve actuator, being connected there to the threaded bolt. The wedge pieces then conically taper off with increasing distance from the gas exchange valve and are attached to the conical clamping sleeve via the thread formed on the threaded bolt.

The number of valve actuator components may be reduced due to the fact that the conical clamping sleeve is formed in one piece by the positioning piston and the threaded segment engages with a mating threaded segment on a radially inner peripheral surface of the positioning piston.

The threaded bolt may be connected to the wedge pieces in a particularly simple manner via annular bulges, peripherally situated on the wedge pieces and the threaded bolt, which engage in annular grooves.

DETAILED DESCRIPTION

Figure 1:
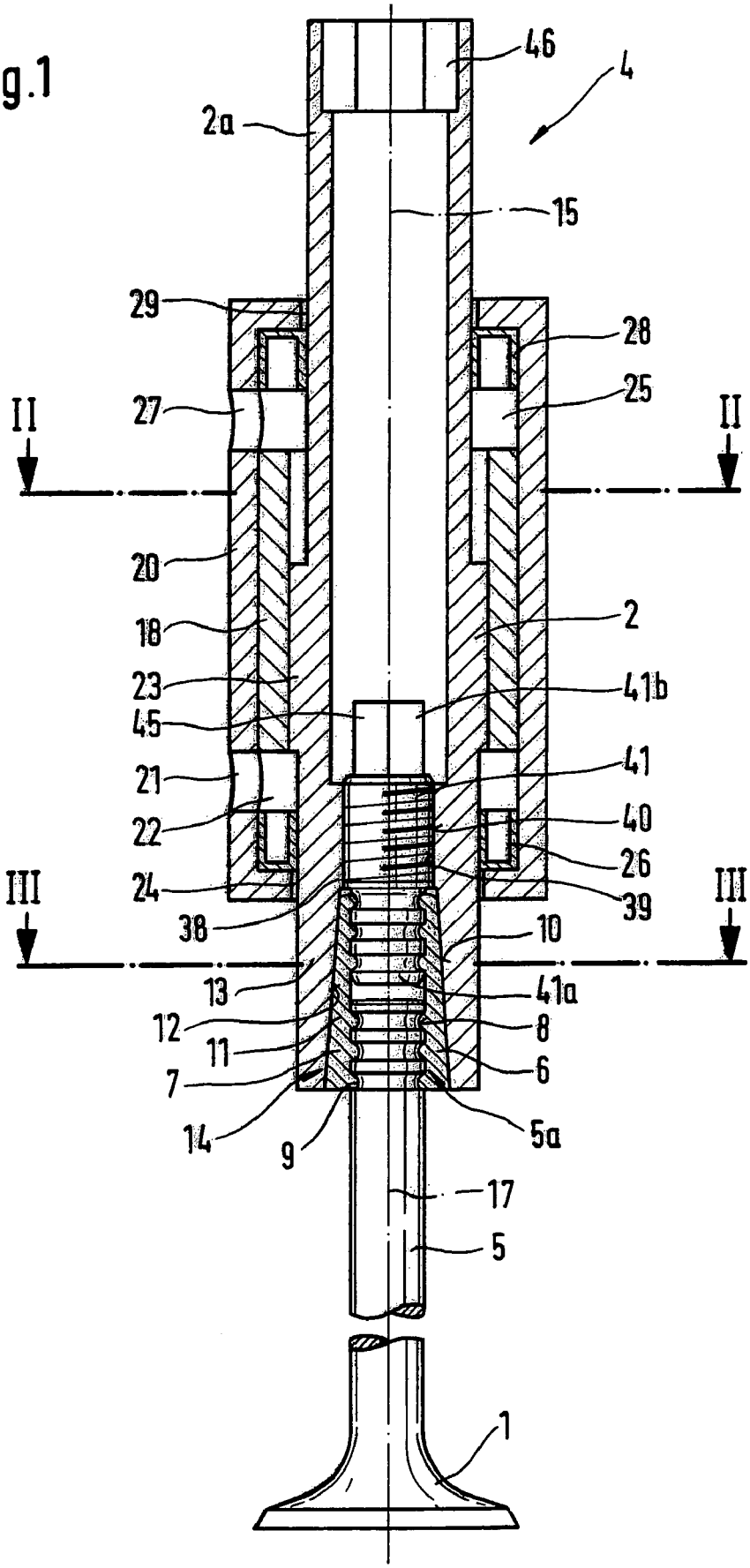
FIG. 1 shows a lateral cross section of a preferred embodiment of a valve actuator according to the present invention.

FIG. 1 shows a gas exchange valve 1 of a valve drive of an internal combustion engine, the gas exchange valve being operated by a positioning piston 2 of a valve actuator 4 in such a way that it performs upward and downward opening and closing movements in the axial direction.

Gas exchange valve 1 has, as is known, a valve stem 5, which extends in the axial direction away from the combustion chamber of the internal combustion engine. Valve stem 5 has a stem end 5*a*, distal from the combustion chamber, which is surrounded by two half-shell-shaped wedge pieces 6, 7. Stem end 5*a* has at least one annular groove 8, into which at least one annular bulge 9 formed on the inner periphery of wedge pieces 6, 7 engages radially. In the present example, a total of three axially equidistant annular grooves 8 on valve stem 5 and three mating annular bulges 9 are provided. Annular bulges 9 are formed by essentially semicircular partial bulges on both wedge pieces 6, 7 which circularly complement one another, forming annular bulges 9.

Wedge pieces 6, 7 form on their outer peripheral surface a conically shaped segment 10, which tapers off with increasing distance from gas exchange valve 1. The two wedge pieces 6, 7 together form a clamping wedge 11, which cooperates with a mating conical inner surface 12 of a conical clamping sleeve 13. Conical clamping sleeve 13 is formed on an end 14 of positioning piston 2 proximal to the combustion chamber in one piece with the positioning piston.

Positioning piston 2 extends in the axial direction along an axis 15 concentrically to a longitudinal axis 17 of valve stem 5 of gas exchange valve 1. Valve actuator 4 has an actuator housing 20, which is axially traversed by positioning piston 2. A guide sleeve 18, within which positioning piston 2 is guided in its axial displacement via a guide collar 23 on positioning piston 2, is located in actuator housing 20. A first chamber 22, which is connected to a first pressure medium line (not illustrated in detail) via a first opening 21 in the wall of actuator housing 20, is formed in actuator housing 20 on the side of guide collar 23 facing the combustion chamber. First chamber 22 is delimited by actuator housing 20, guide sleeve 18 and positioning piston 2, including guide collar 23. A first sealing ring 26 prevents the pressure medium in first chamber 22, for example, hydraulic fluid, from escaping from actuator housing 20 via a first annular gap 24.

A second chamber 25, which is connected to a second pressure medium line (also not illustrated in detail) via a second opening 27 in the wall of actuator housing 20, is formed in actuator housing 20 on the side of guide collar 23 facing away from the combustion chamber. Second chamber 25 is also delimited by actuator housing 20, guide sleeve 18 and positioning piston 2, including guide collar 23. A second sealing ring 28 prevents the pressure medium in second chamber 25 from escaping from actuator housing 20 via a second annular gap 29.

Positioning piston 2 is designed in the form of a hollow cylinder. A constriction 38 on the inner periphery of positioning piston 2 is located between conical sleeve 13 proximal to the combustion chamber and an end 2*a* of positioning piston 2 distal from the combustion chamber. An inner thread 39 is formed in the area of constriction 38, which engages with a mating outer thread 40 on a threaded bolt 41. Threaded bolt 41 is situated concentrically within positioning piston 2. Outer thread 40 extends via a threaded segment axially to threaded bolt 41 and engages, at least partially, with outer thread 40.

Threaded bolt 41 is axially connected to valve stem 5 in a form-fitting manner so it is able to rotate in the peripheral direction. For this purpose, conical clamping sleeve 13 and wedge pieces 6, 7 extend beyond stem end 5*a* of valve stems 5, surrounding end 41*a* of threaded bolt 41 proximal to the combustion chamber. At least one radial projection, which in the present example is designed as an annular bulge engaging radially in at least one depression on the outer periphery of threaded bolt 41, is provided in the area of end 41*a* on the inner periphery of clamping wedge 11. Depression is designed in the present example as an annular groove and there are a total of three axially equidistant bulges situated on clamping wedge 11 and three mating grooves on threaded bolt 41 which radially engage with bulges.

Figure 2:
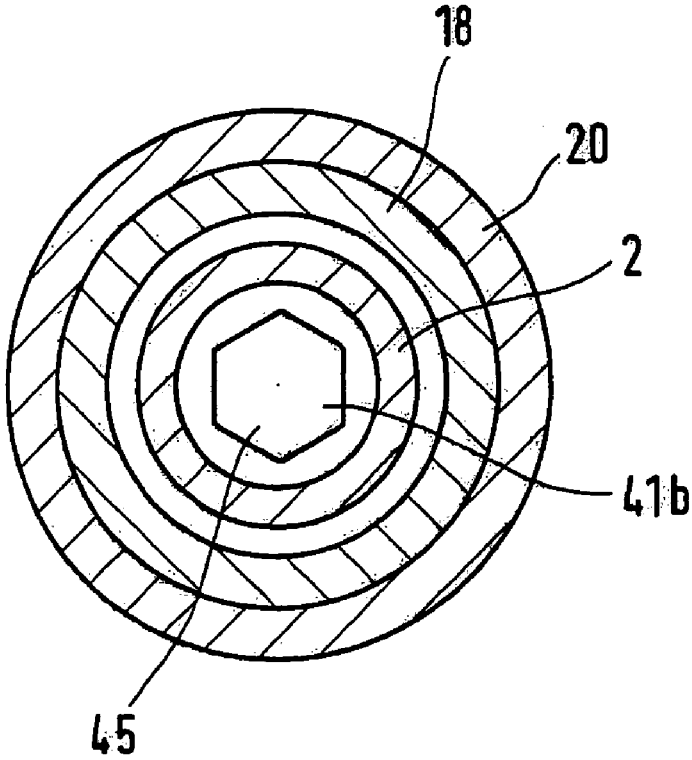
FIG. 2 shows a cross section along line II-II in FIG. 1.

As is apparent from FIG. 2, an end 41*b* of threaded bolt 41 distal from the combustion chamber is designed as an outer hexagon 45 for the application of a wrench (not illustrated). Threaded bolt 41 may be screwed into inner thread 39 using the wrench, clamping wedge 11 being axially and radially clamped to conical clamping sleeve 13 due to the form-fitting connection to clamping wedge 11. To prevent positioning piston 2 from being entrained by friction into rotation when threaded bolt 41 is screwed in, a second, also hexagonal, wrench may be used in a tool receptacle 46 on stem end 2*a* to secure it.

Figure 3:
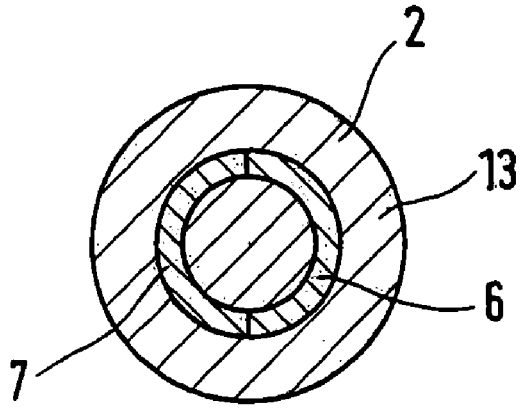
FIG. 3 shows a cross section along line III-III in FIG. 1.

FIG. 3 also shows that both wedge pieces 6, 7 rest radially in the shape of a half-shell on the conical clamping sleeve.

Against this background, the function of the valve actuator is the following:

FIG. 1 shows gas exchange valve 1 in an open position, in which both chambers 22, 25 are pressurized via the pressure medium lines. Due to the smaller axial piston surface area of positioning piston 2 on first chamber 22, positioning piston 2 is axially offset with respect to the combustion chamber. Second chamber 25 is depressurized to close gas exchange valve 1; first chamber 22 always remains pressurized. Due to the overpressure in first chamber 22, positioning piston 2 is then moved upward toward second chamber 25.

To assemble valve actuator 4, gas exchange valve 1 is introduced into the valve stem guide of the cylinder head (not illustrated) and then wedge pieces 6, 7 are placed on stem end 5*a*. End 41*a* of threaded bolt 41 is also secured between wedge pieces 6, 7. Subsequently, valve actuator 4 is placed from above onto the pre-assembled components gas exchange valve 1, threaded bolt 41, and wedge pieces 6, 7 until the outer surface of clamping wedge 11 comes to rest on conical inner surface 12. A wrench is then positioned in positioning piston 2 on outer hex 45, and threaded bolt 41 is axially adjusted by rotating over thread 37, 39. In this way, clamping wedge 11 and conical clamping sleeve 13 are attached to each other. Positioning piston 2 may have to be secured in the direction of rotation using another tool.

The applicability of the present invention is not limited to the above-described exemplary embodiment. Thus, numerous modification options of the specific embodiment are conceivable, which do not essentially alter the inventive idea. Thus, positioning piston 2 may be installed more or less completely in actuator housing 20. The number of grooves and bulges may vary. The grooves and bulges may also be formed on another component without modifying the operating principle of the valve actuator. The points of application of the wrenches may be designed differently from the above-described embodiment.

What is claimed is:

1. A valve actuator for operating a gas exchange valve of an internal combustion engine, comprising:

a valve stem;

a conical clamping sleeve;

a sleeve-shaped positioning piston connected to the valve stem;

at least two shell-shaped wedge pieces, which enclose a stem end of the valve stem, and whose radially outer peripheral surfaces have a conical segment which tapers off with increasing distance from the gas exchange valve and which is at least partially surrounded by the conical clamping sleeve having a mating conical inner surface and is connected to the positioning piston; and a threaded bolt, the wedge pieces being axially form-fittingly and rotatably connected to the threaded bolt, the threaded bolt having at least one threaded segment via which the wedge pieces and the conical clamping sleeve are axially attachable to one another.

2. The valve actuator according to claim 1, wherein the wedge pieces extend beyond the stem end as an axial extension of the valve stem and there partially encompass the threaded bolt axially in a form-fitting manner.

3. The valve actuator according to claim 1, wherein the conical clamping sleeve is formed by the positioning piston, and the threaded segment at least partially engages with a mating thread on the positioning piston.

4. The valve actuator according to claim 3, wherein the threaded segment extends in an axial direction on an outer periphery of the threaded bolt.

5. The valve actuator according to claim 4, wherein at least one radial projection, which radially engages with at least one radial depression on an inner surface of the wedge pieces, is formed on the outer periphery of the threaded bolt.

6. The valve actuator according to claim 5, wherein the at least one radial depression and the at least one radial projection have an annular shape.

7. The valve actuator according to claim 6, wherein the at least one depression on the threaded bolt is situated in an area of its end facing the valve stem, and the threaded segment is behind the stem end, viewed in an axial direction from the gas exchange valve.

8. The valve actuator according to claim 7, wherein three peripheral depressions are situated on the threaded bolt which each engage with three mating projections on the wedge pieces.

* * * * *